United States Patent [19]

Fischer et al.

[11] 4,093,203

[45] June 6, 1978

[54] DEVICE FOR SLOWING DOWN PRINTING SPECIMEN IN THE FOLDING APPARATUS

[75] Inventors: Rudolf Fischer, Lu-Oggersheim; Rudolf Frey, Dirmstein, both of Germany

[73] Assignee: Albert-Frankenthal AG, Frankenthal, Germany

[21] Appl. No.: 709,749

[22] Filed: Jul. 29, 1976

[30] Foreign Application Priority Data

Sep. 17, 1975 Germany ..... 2541502

[51] Int. Cl.[2] ..... B41F 13/56

[52] U.S. Cl. ..... 270/20; 270/50; 270/76; 271/202

[58] Field of Search ..... 270/6, 10, 13, 14, 19, 270/38, 42, 47–50, 60, 70–77, 4, 5, 20; 271/270, 273–274, 202; 101/232

[56] References Cited

U.S. PATENT DOCUMENTS

| | | | |
|---|---|---|---|
| 2,172,361 | 9/1939 | Clauberg | 270/47 |
| 3,315,956 | 4/1967 | Lyman | 271/202 |
| 3,337,211 | 8/1967 | Bilane | 270/76 |
| 3,521,512 | 7/1970 | Woessner | 270/60 |
| 3,608,889 | 9/1971 | Woessner | 270/76 |

*Primary Examiner*—Edgar S. Burr
*Assistant Examiner*—A. Heinz
*Attorney, Agent, or Firm*—Allison C. Collard

[57] ABSTRACT

The invention is concerned with a device for slowing down a fed printing specimen as it is fed to the paddle wheel, and includes a pair of rollers, one of which is adjustable relative to the other to provide for an adjustable wedge portion therebetween which includes means to slow the speed of the fed printing specimen down as it is fed to the paddle wheel.

5 Claims, 2 Drawing Figures

DEVICE FOR SLOWING DOWN PRINTING SPECIMEN IN THE FOLDING APPARATUS

The present invention relates to a device for slowing down printing specimens before they are introduced into the paddle wheel of the folding apparatus in a rotary printing press.

In view of the faster rotating printing presses being used, a problem free delivery of the printing specimen by means of paddle wheels is no longer possible. Due to the striking speed onto the bottom portion of the individual paddle wheels, the front edges of the printing specimen becomes damaged. Furthermore, the printing specimen slur on the paddle wheel faces due to the extremely high sliding speed. In view of this criteria, limits are imposed on the speed requirements, in particular in rotogravure printing presses in accordance with the present state of the art.

In accordance with the invention, a device is provided which even at the highest possible speed for feeding the printing specimen, enables a delivery of the printing specimen without damaging it.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed.

In the drawings, wherein similar reference numerals denote similar elements throughout the several views:

One of the embodiments is shown in the drawings.

Figure 1:
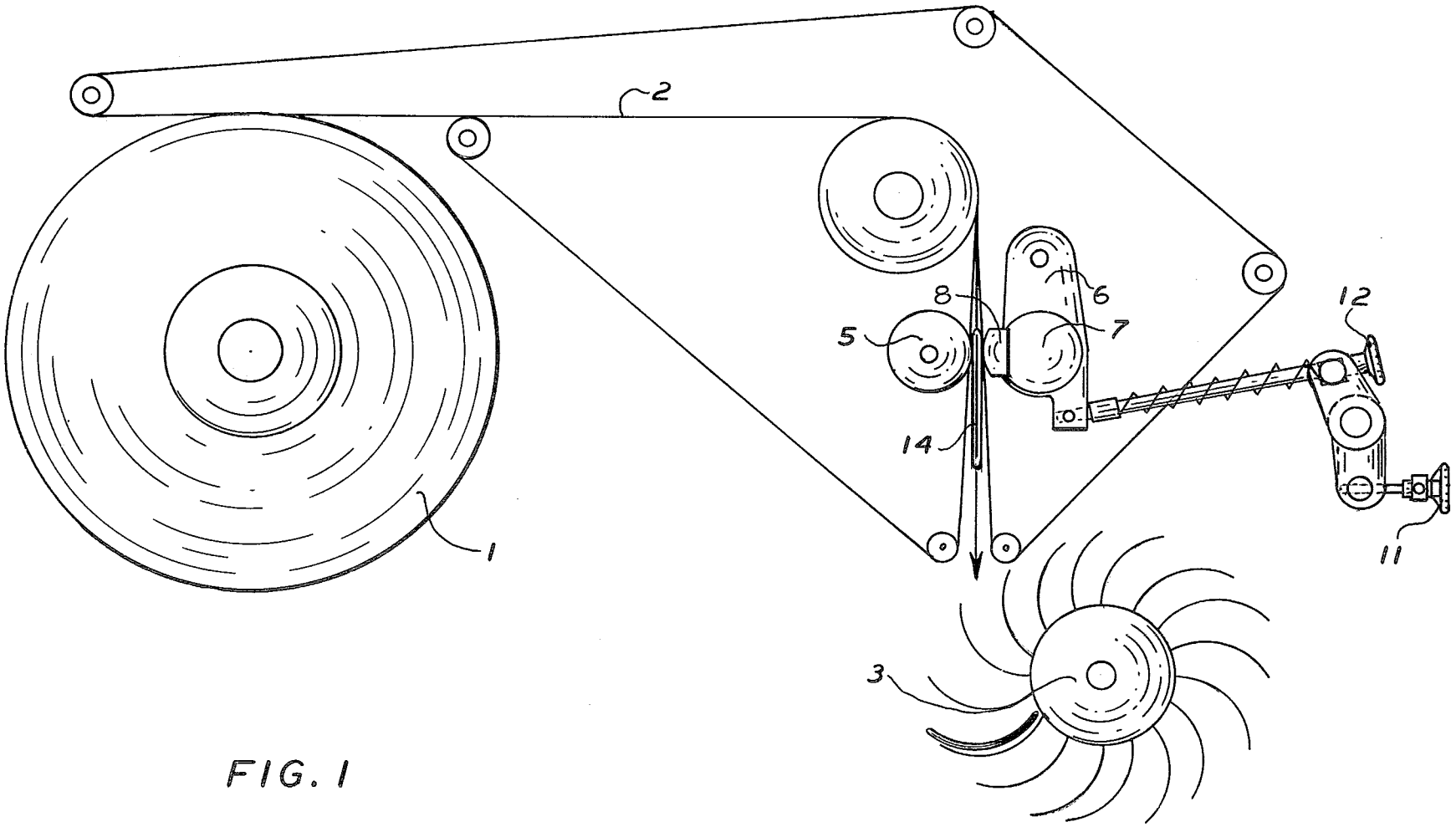
FIG. 1 is a view of the delivery system.
Figure 2:
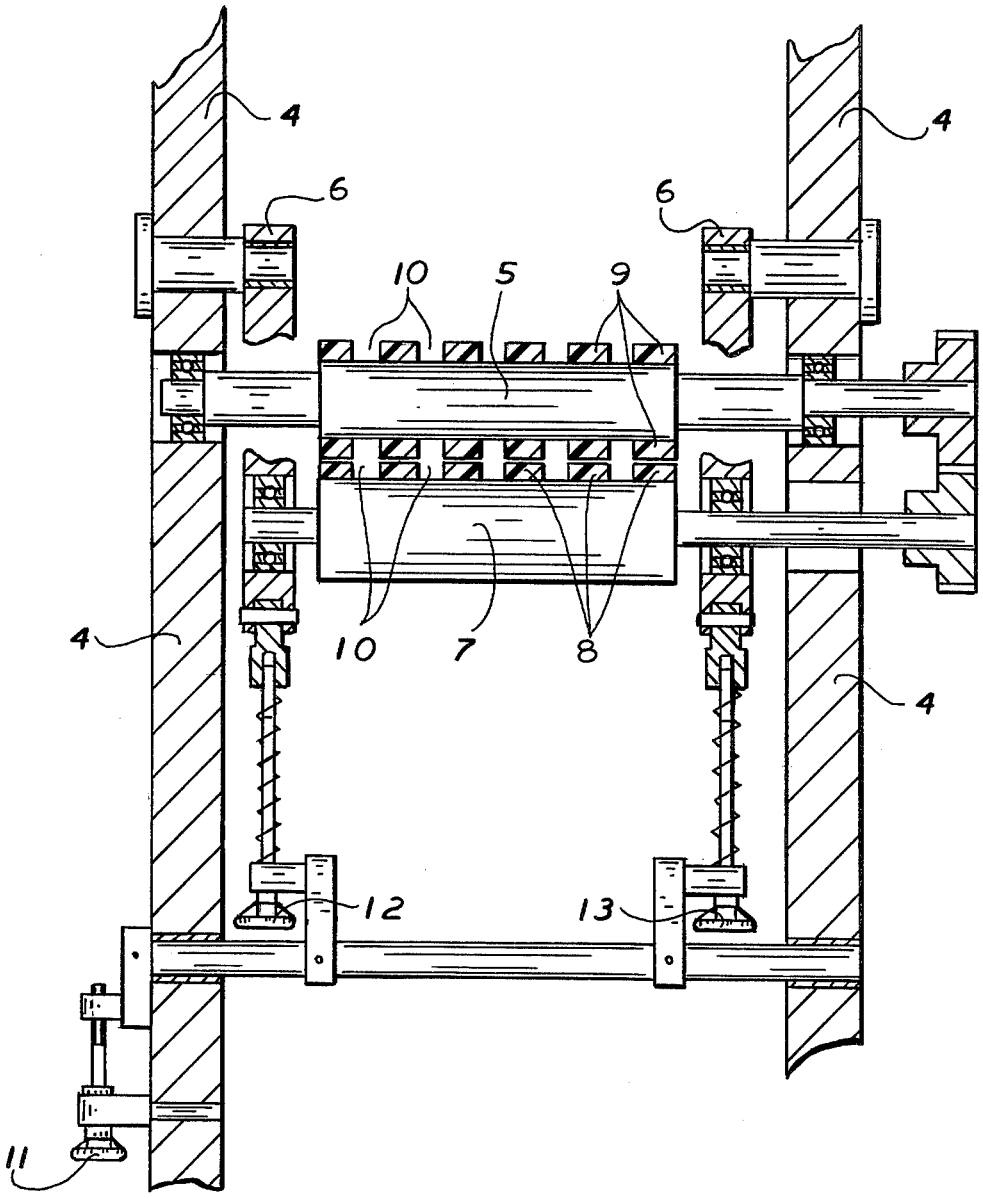
FIG. 2 is a cross sectional view of the delivery system.

Referring to FIGS. 1 and 2, the printing specimens 14 are fed from the folding rotating cylinder 1 into the subsequent conveyor belt 2 to the paddle wheel delivery system. The number of deliveries on one folding apparatus as well as the conveyor belt 2 subsequent to cylinder 1 may be varied as desired. In front of paddle wheel 3, a roller 5 is rigidly mounted in side frame 4.

A pivotable roller 7 mounted on levers 6, for example, is associated with a roller 5; roller 7 being provided with a bar 8 running longitudinally with respect to the roller axis. Bar 8 is provided with a preferably elastic plastic material having apertures 10. Roller 5 is provided with rings 9 made of the same elastic plastic material. Conveyor belts 2 run through apertures 10, whereby the belts form an adjustable slightly open wedge in the area of roller 5 and roller 7. Pivotable roller 7 is adjustable with respect to the wedge opening required by the thickness of the printing specimen by means of bar 8, and adjustable means 11 in parallel direction and individually by means of adjustable elements 12 and 13 with respect to rings 9 of roller 5. Roller 5 is driven and may have a given number of revolutions with respect to the fed printing specimen. Roller 7 is driven in a manner that bar 8 mounted thereon has the same rotational speed as rings 9 on roller 5 and in a synchronous speed with the fed printing specimen 14. The rotational speed of rings 9 on roller 5 as well as the rotational speed of bar 8 on roller 7 are less than the feeding speed of conveyor belts 2 which have the same speed as cylinder 1. When the printing specimen 14 are fed between rollers 5 and 7 they are gripped at their ends and are slowed down in accordance with the reduced rotational speed of rings 9 and bar 8 with respect to conveyor belts 2.

Due to the appreciably lower sliding speed of the printing specimen in the paddle wheel, and the reduced sliding speed on the paddle wheel surfaces, a damaging of the printing specimen at high operating speeds of the printing press is prevented, the slur effect is reduced and a higher rotational operating speed is made possible.

While only a few embodiments of the present invention have been shown and described, it will be obvious to those skilled in the art that many changes and modifications may be made thereto without departing from the spirit and scope of the invention.

What is claimed is:

1. Apparatus for slowing down fed printing specimens which are fed from a folding cylinder by means of a conveyor belt at a given speed before they are introduced into a paddle wheel of the folding apparatus in a rotary printing press, comprising:

a frame;

a pair of rollers supported on said frame and including a driven roller and a cooperating, freely pivotable roller forming a wedge portion therebetween interposed between said folding cylinder and said paddle wheel, the conveyor belt and the fed printing specimens passing through said wedge portion, said driven roller being fixed for rotation in said frame in synchronism with the fed printing specimens, said driven roller including on the outer periphery thereof at least two peripherally spaced rings forming therebetween a first aperture, said pivotable roller being movably coupled to said frame and adjustable for movement relative to said driven roller, said pivotable roller including on the outer periphery thereof a radially protruding bar running longitudinally therealong, said bar having at least one undercut portion forming a second aperture adapted to be aligned with said first aperture for providing a path through which said conveyor belt runs, said rollers being operable at a lower speed than that of said given speed of said conveyor belt, so as to reduce the impact speed of the specimens when they are introduced into said paddle wheel; and adjustable means to adjust the distance between said pair of rollers, coupled to said pivotable roller, so as to permit adjustment relative to the thickness of said fed printing specimen.

2. The apparatus as defined in claim 1, including lever means coupling said pivotally mounted roller to said frame.

3. The apparatus as defined in claim 2, said adjustable means including first adjustment means to adjust said pivotable roller to adjust said wedge portion, and a second adjustment means including a pair of individual adjustment elements to adjust said bar relative to said rings.

4. The apparatus as defined in claim 3, said driven roller and said pivotable roller being driven at a speed such that said rings and said bar have the same peripheral speed and in synchronous speed with the fed printing specimen and lower than the speed of said conveyor belt.

5. The apparatus as defined in claim 4, said bar being provided with a plurality of said second apertures, said driven roller including a plurality of said spaced rings to define therebetween a plurality of said first apertures equal in number to said second apertures, said rings and said bar being formed of plastic elastic material to facilitate gripping of the fed printing specimen as it is fed between said rollers and slowing down of the fed printing specimens and gripped between said rings and said bar.

* * * * *